US011324331B2

(12) United States Patent
Cenabre

(10) Patent No.: US 11,324,331 B2
(45) Date of Patent: May 10, 2022

(54) INCLINED AND VENTED MATTRESS ASSEMBLY

(71) Applicant: Jose Johniel Cenabre, Westbury, NY (US)

(72) Inventor: Jose Johniel Cenabre, Westbury, NY (US)

( * ) Notice: Subject to any disclaimer, the term of this patent is extended or adjusted under 35 U.S.C. 154(b) by 209 days.

(21) Appl. No.: 16/696,485

(22) Filed: Nov. 26, 2019

(65) Prior Publication Data

US 2021/0153664 A1 May 27, 2021

(51) Int. Cl.
*A47C 21/04* (2006.01)

(52) U.S. Cl.
CPC ..... *A47C 21/044* (2013.01)

(58) Field of Classification Search
CPC ... A47C 21/044; A47C 21/048; A47C 21/042; A47C 27/14; A47C 27/04; A47C 20/022
See application file for complete search history.

(56) References Cited

U.S. PATENT DOCUMENTS 1,432,875 A 10/1922 Layagetto
2,493,067 A * 1/1950 Goldsmith ..... A47C 21/048 5/726
3,742,528 A * 7/1973 Munch ..... A47C 27/20 5/723
5,175,899 A 1/1993 Lou
5,697,112 A * 12/1997 Colavito ..... A47C 20/027 5/490
7,328,471 B1 2/2008 Stohr
7,784,129 B2 8/2010 Javaruski
7,918,103 B1 * 4/2011 Purvis ..... A47C 21/044 62/259.3
9,161,632 B1 10/2015 Tomaini
9,775,451 B1 * 10/2017 Chon ..... A47G 9/10
2003/0019044 A1 1/2003 Larsson
2004/0003469 A1 * 1/2004 Gill-Barajas ..... A47C 21/08 5/636
2004/0168257 A1 * 9/2004 Torrez ..... A47C 27/00 5/731
2007/0257018 A1 11/2007 Huang
2008/0263775 A1 * 10/2008 Clenet ..... A47C 27/144 5/694
2012/0110734 A1 5/2012 An
2013/0212808 A1 * 8/2013 Lachenbruch ..... A47C 27/00 5/691
2017/0325596 A1 * 11/2017 Torbet ..... A47C 27/18
2018/0242753 A1 * 8/2018 Ghanei ..... A47C 27/056

* cited by examiner

*Primary Examiner* — Robert G Santos
*Assistant Examiner* — Alison N Labarge

(57) ABSTRACT

An inclined and vented mattress assembly for elevating an upper body of a user includes a block that comprises foamed elastomer so that the block is resiliently compressible. The block is wedge shaped so that a first end of the block is dimensionally thicker than a second end of the block. The block has a base that is sized complementarily to a bed frame so that the block is configured to be positioned upon the bed frame. A set of channels that is positioned in the block extends between at least two openings that are positioned in the block. The set of channels is configured to vent the block to cool the block and a user positioned thereupon. The block being wedge shaped elevates the upper body of the use, promoting relaxation and restful sleep.

17 Claims, 5 Drawing Sheets

INCLINED AND VENTED MATTRESS ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mattress assemblies and more particularly pertains to a new mattress assembly for elevating an upper body of a user.

(2) Description of Related Art Including Information Disclosed Under 37 CFR 1.97 and 1.98

The prior art relates to mattress assemblies. Prior art mattress assemblies for elevating an upper body of a user may comprise angled bed frames. Prior art mattress assemblies with selective heating and cooling capabilities may comprising fans for venting an innerspring section of a mattress.

BRIEF SUMMARY OF THE INVENTION

An embodiment of the disclosure meets the needs presented above by generally comprising a block that comprises foamed elastomer so that the block is resiliently compressible. The block is wedge shaped so that a first end of the block is dimensionally thicker than a second end of the block. The block has a base that is sized complementarily to a bed frame so that the block is configured to be positioned upon the bed frame. A set of channels that is positioned in the block extends between at least two openings that are positioned in the block. The set of channels is configured to vent the block to cool the block and a user positioned thereupon. The block being wedge shaped elevates an upper body of the use, promoting relaxation and restful sleep.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
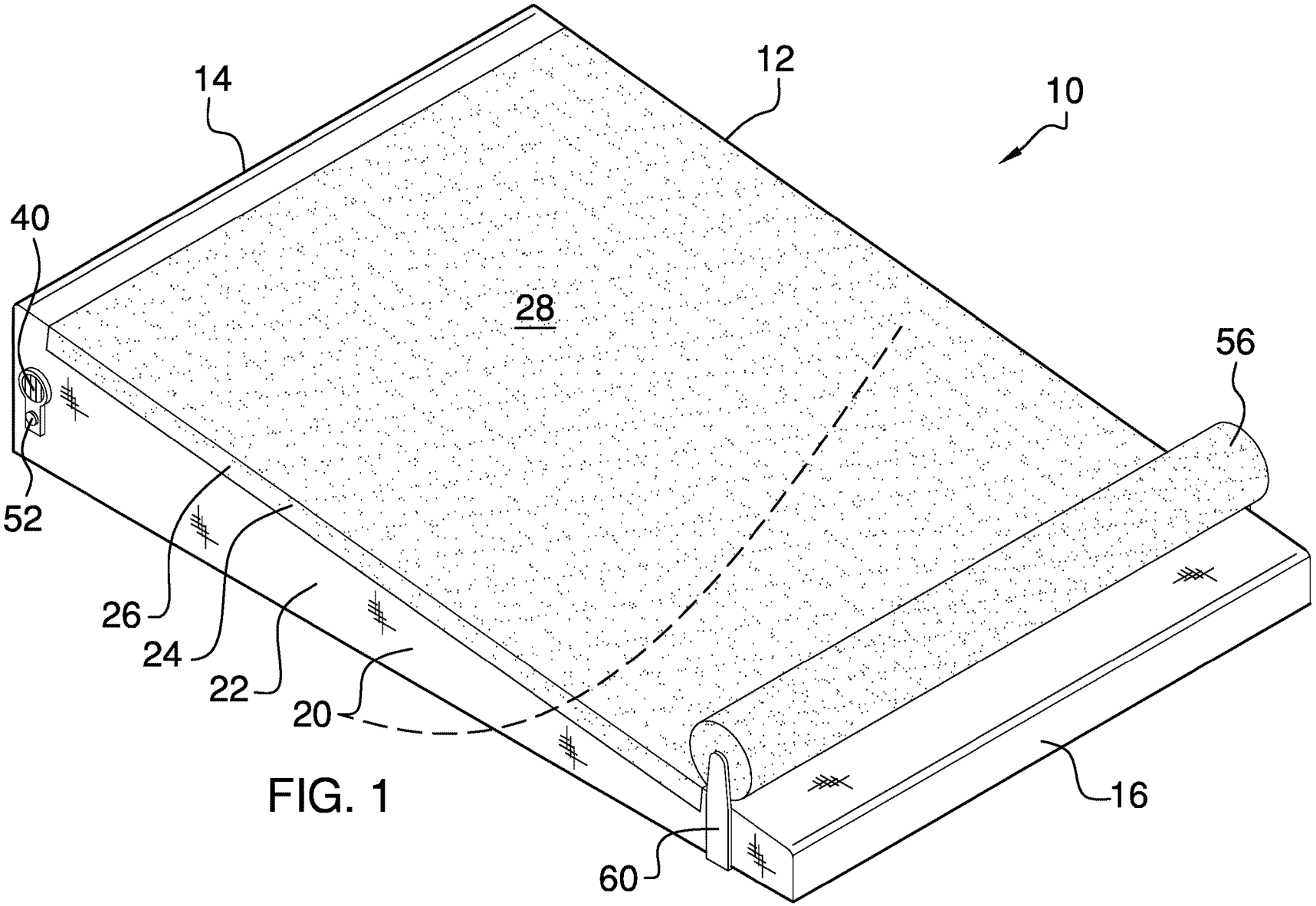
FIG. 1 is an isometric perspective view of an inclined and vented mattress assembly according to an embodiment of the disclosure.
Figure 2:
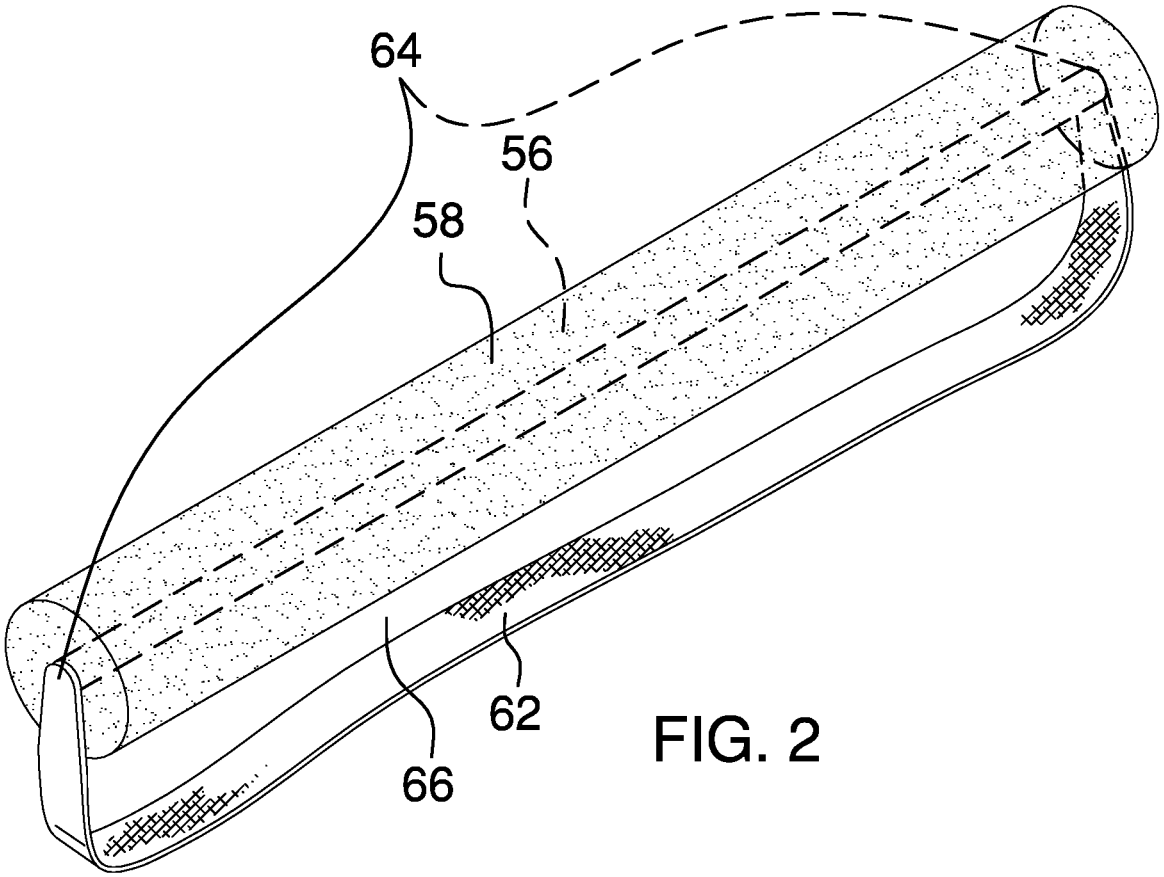
FIG. 2 is an isometric perspective view of an embodiment of the disclosure.

With reference now to the drawings, and in particular to FIGS. 1 through 5 thereof, a new mattress assembly embodying the principles and concepts of an embodiment of the disclosure and generally designated by the reference numeral 10 will be described.

As best illustrated in FIGS. 1 through 5, the inclined and vented mattress assembly 10 generally comprises a block 12 that comprises foamed elastomer so that the block 12 is resiliently compressible. The block 12 is wedge shaped so that a first end 14 of the block 12 is dimensionally thicker than a second end 16 of the block 12. The block 12 has a base 18 that is sized complementarily to a bed frame so that the block 12 is configured to be positioned upon the bed frame.

The first end 14, the second end 16, and opposing sides 20 of the block 12 are perpendicular to the base 18. The block 12 measures between 20.0 and 46.0 centimeters thick adjacent to the first end 14 and between 7.0 and 38.0 thick adjacent to the second end 16. The block 12 may measure between 25.0 and 35.0 centimeters thick adjacent to the first end 14 and between 7.6 and 23.0 thick adjacent to the second end 16.

The block 12 comprises a lower section 22 and an upper section 24. The lower section 22 comprises at least one of latex foam and high density foam. A recess 26 extends into an upper face 28 of the block 12. The recess 26 extends from proximate to the first end 14 to proximate to the second end 16 of the block 12. The recess 26 extends between the opposing sides 20 of the block 12. The recess 26 extends from 7.0 to 15.0 centimeters into the upper face 28. The recess 26 may extend approximately 10.2 centimeters into the upper face 28. The upper section 24 is positioned in the recess 26 and is coupled to the lower section 22 so that the upper section 24 occupies the recess 26. The upper section 24 comprises viscoelastic polyurethane foam.

A set of channels 30 that is positioned in the block 12 extends between at least two openings 32 that are positioned in the block 12. The set of channels 30 is configured to vent the block 12 to cool the block 12 and a user positioned thereupon. The block 12 being wedge shaped elevates the upper body of the use, promoting relaxation and restful sleep.

The set of channels 30 is positioned in the lower section 22 proximate to the upper section 24. The set of channels 30 may comprise a set of pipes 34. The pipes 34 are resiliently flexible so that they flex when the user lays upon the block 12. The pipes 34 are open topped so that the pipes 34 are substantially C shaped when viewed longitudinally. The pipes 34 are configured to allow direct contact of air with the upper section 24 of the block 12. The set of channels 30 may comprise a pair of first segments 36 and a set of three second segments 38. The first segments 36 are figure eight shaped. Each second segment 38 is coupled to and extends between the first segments 36. The present invention anticipates the set of channels 30 comprising other configurations, such as, but not limited to, looping configurations, zigzag configurations, and the like.

Figure 3:
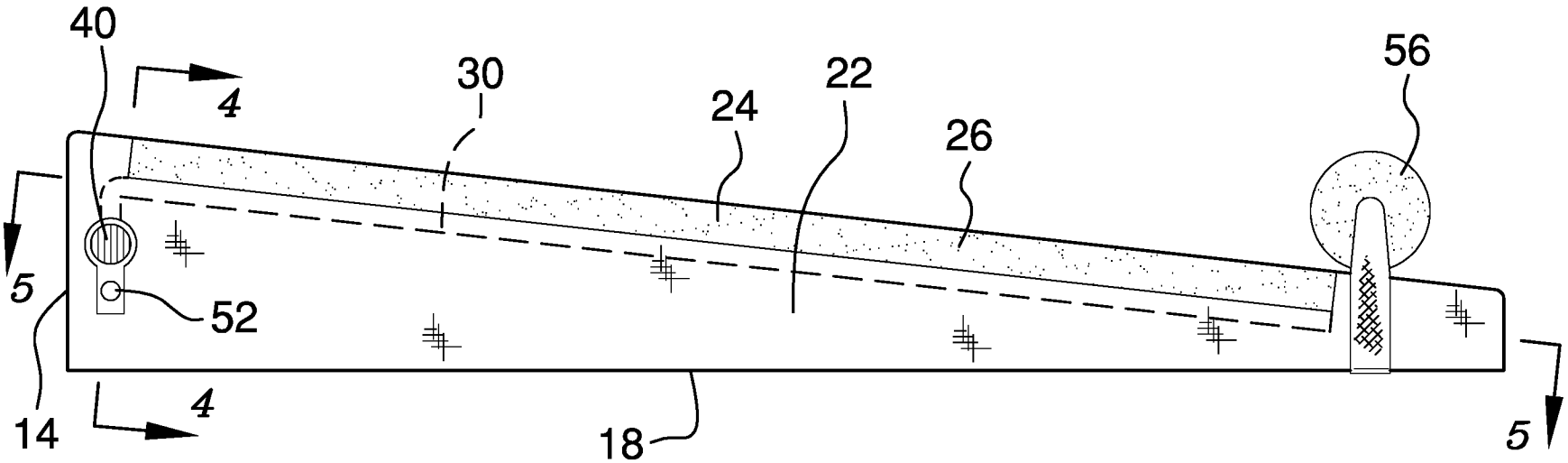
FIG. 3 is a side view of an embodiment of the disclosure.

A blower 40 is coupled to the block 12 proximate to a respective one of the openings 32 so that the blower 40 is in fluidic communication with the set of channels 30. The blower 40 is configured to motivate air through the set of channels 30 to cool the block 12. The blower 40 may be positioned in a respective opposing side 20 proximate to the first end 14 of the block 12, as shown in FIG. 3.

A power module 42 is coupled to the block 12. The power module 42 is operationally coupled to the blower 40 so that the power module 42 is positioned to selectively power the blower 40. The power module 42 may comprise a power cord 44, or other powering means, such as, but not limited to, batteries and the like. A plug 46 of the power cord 44 is configured to be plugged into an electrical outlet to couple the blower 40 to a source of electrical current.

A heating module 48 is coupled to the block 12 and is operationally coupled to the power module 42. The heating module 48 is configured to selectively heat the air that passes through the set of channels 30 to warm the block 12 and the user positioned thereupon. The heating module 48 comprises a heating element 50. The heating element 50 is integral to at least one of the blower 40, as shown in FIG. 5, and the set of pipes 34, as shown in FIG. 4.

A controller 52 is coupled to the block 12 proximate to the blower 40. The controller 52 is operationally coupled to the power module 42, the blower 40, and the heating module 48 so that the controller 52 is positioned to selectively couple the blower 40 and the heating module 48 to the power module 42. The controller 52 may be dial type, or other type, such as, but not limited to, touch screen type, multiple depressible button type, and the like. The controller 52 is configured to be selectively turned to actuate the blower 40 and to select a heating level for the heating module 48.

Figure 4:
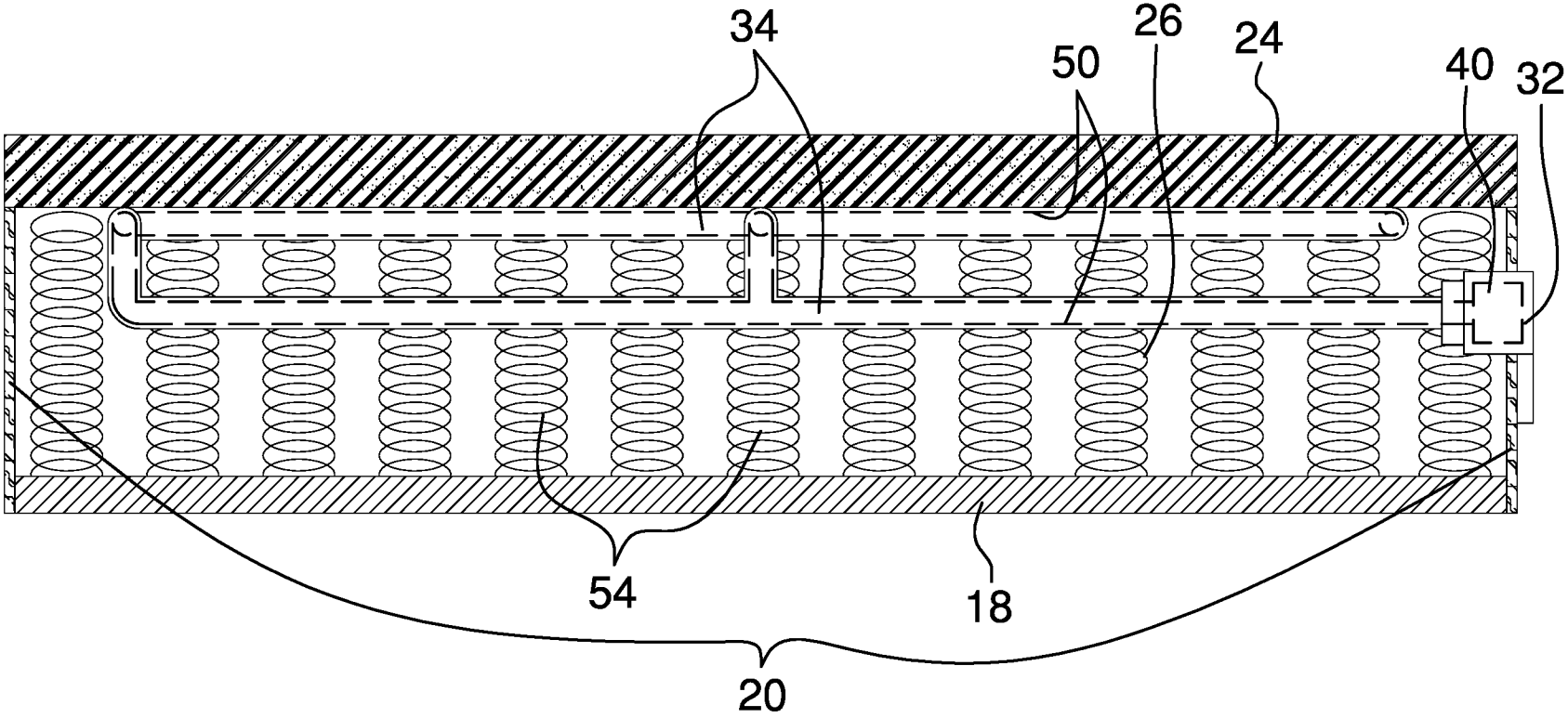
FIG. 4 is a cross-sectional view of an embodiment of the disclosure.
Figure 5:
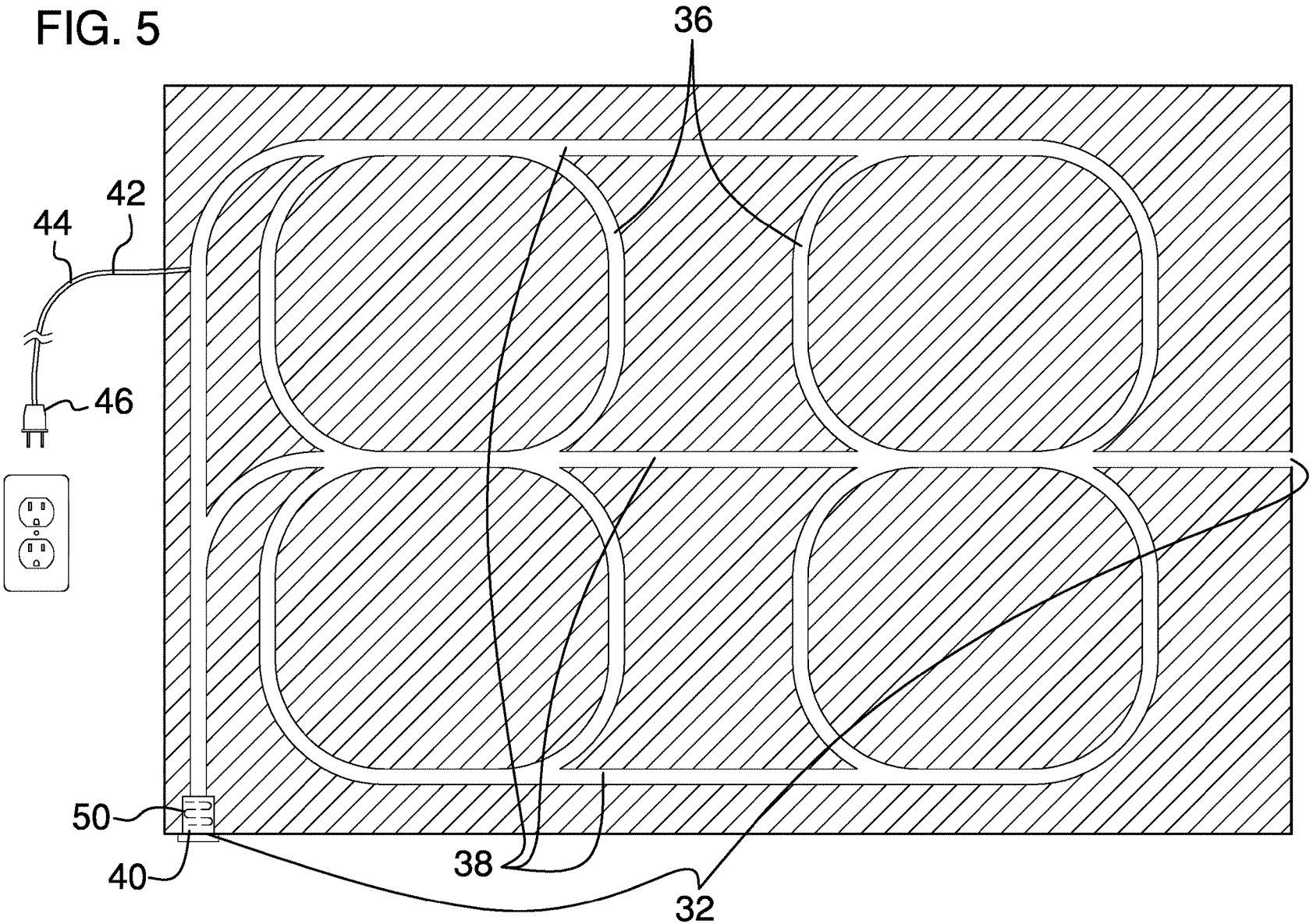
FIG. 5 is a cross-sectional view of an embodiment of the disclosure.

The assembly 10 may comprise a set of springs 54 that is coupled to and positioned in the lower section 22 of the block 12, as shown in FIG. 4. Each spring 54 extends from proximate to the base 18 to proximate to the upper section 24 of the block 12. The set of springs 54 is configured to support a user who is positioned upon the upper section 24 of the block 12.

The assembly 10 also comprises a cylinder 56 that is selectively couplable to the block 12, as shown in FIG. 1. The cylinder 56 is positioned on the upper face 28 proximate to the second end 16 of the block 12 and extends substantially between the opposing sides 20 of the block 12. The cylinder 56 comprises at least one of latex foam and high density foam so that the cylinder 56 is resiliently compressible. The cylinder 56 is configured to selectively position feet of the user to elevate the feet. A user also is positioned to manipulate the cylinder 56 with their feet to massage the feet.

The cylinder 56 being selectively couplable to the block 12 allows the user to remove the cylinder 56 to change bedding. A shell 58 that is positioned around the cylinder 56 comprises at least one of fabric and leather. The shell 58 is configured to shield the cylinder 56 to prevent soiling of the cylinder 56.

A fastener 60 that is coupled to the cylinder 56 is configured to selectively couple to the block 12 to couple the cylinder 56 to the block 12. The fastener 60 may comprise a strap 62, or other fastening means, such as, but not limited to, hook and loop 66 fasteners, snaps, and the like. The strap 62 is coupled to and extends between opposing endpoints 64 of the cylinder 56 so that the cylinder 56 and the strap 62 define a loop 66. The loop 66 is positioned for selective insertion of the block 12 to couple the cylinder 56 to the block 12.

In use, the block 12 is positioned on a bed frame, such as a platform type bed frame. The user is positioned to lay upon the block 12 with the user's head proximate to the first end 14 and the upper body of the user elevated relative to the feet of the user. If heating or cooling is desired, the controller 52 is used to selectively actuate the blower 40, for cooling, or both the blower 40 and the heating module 48, for heating. The cylinder 56 positioned proximate to the second end 16 of the block 12 is available to elevate the feet of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An inclined and vented mattress assembly comprising:

a block, the block comprising foamed elastomer such that the block is resiliently compressible, the block being wedge shaped such that a first end of the block is dimensionally thicker than a second end of the block, the block having a base sized complementarily to a bed frame wherein the block is configured for positioning upon the bed frame;

a set of channels positioned in the block, the set of channels extending between at least two openings positioned in the block such that the set of channels is configured for venting the block;

the block comprising a lower section, the lower section comprising at least one of latex foam and high density foam, a recess extending into an upper face of the block, the recess extending from proximate to the first end to proximate to the second end of the block, the recess extending between opposing sides of the block; and an upper section positioned in the recess and coupled to the lower section such that the upper section occupies the recess, the upper section comprising viscoelastic polyurethane foam; and a set of springs coupled to and positioned in the lower section of the block, each spring extending from proximate to the base to proximate to the upper section of the block wherein the set of springs is configured for supporting a user positioned upon the upper section of the block.

2. The assembly of claim 1, ti including the first end, the second end, and opposing sides of the block being perpendicular to the base.

3. The assembly of claim 2, further including the block measuring between 20.0 and 46.0 centimeters thick adjacent to the first end and between 7.0 and 38.0 centimeters thick adjacent to the second end.

4. The assembly of claim 3, ti including the block measuring between 25.0 and 35.0 centimeters thick adjacent to the first end and between 7.6 and 23.0 centimeters thick adjacent to the second end.

5. The assembly of claim 1, further including the recess extending from 7.0 to 15.0 centimeters into the upper face.

6. The assembly of claim 5, further including the recess extending approximately 10.2 centimeters into the upper face.

7. The assembly of claim 1, further including the set of channels being positioned in the lower section proximate to the upper section.

8. The assembly of claim 7, further including the set of channels comprising a pair of first segments and a set of three second segments, the first segments being figure eight shaped, each second segment being coupled to and extending between the first segments.

9. The assembly of claim 1, further comprising:

a blower coupled to the block proximate to a respective one of the openings such that the blower is in fluidic communication with the set of channels wherein the blower is configured for motivating air through the set of channels for cooling the block; and a power module coupled to the block, the power module being operationally coupled to the blower such that the power module is positioned for selectively powering the blower.

10. The assembly of claim 9, further including the power module comprising a power cord wherein a plug of the power cord is configured for plugging into an electrical outlet for coupling the blower to a source of electrical current.

11. The assembly of claim 9, further comprising:

a heating module coupled to the block, the heating module being operationally coupled to the power module wherein the heating module is configured for selectively heating the air passing through the set of channels for warming the block; and a controller coupled to the block proximate to the blower, the controller being operationally coupled to the power module, the blower, and the heating module such that the controller is positioned for selectively coupling the blower and the heating module to the power module.

12. The assembly of claim 11, further including the heating module comprising a heating element, the heating element being integral to at least one of the blower and the set of pipes.

13. The assembly of claim 11, further including the controller being dial type wherein the controller is configured for selectively turning for actuating the blower and for selecting a heating level for the heating module.

14. The assembly of claim 1, further comprising:

a cylinder selectively couplable to the block such that the cylinder is positioned on the upper face proximate to the second end of the block and such that the cylinder extends substantially between the opposing sides of the block, the cylinder comprising at least one of latex foam and high density foam such that the cylinder is resiliently compressible wherein the cylinder is configured for selectively positioning feet of the user; and a fastener coupled to the cylinder, the fastener being configured for selectively coupling to the block for coupling the cylinder to the block.

15. The assembly of claim 14, further including the fastener comprising a strap coupled to and extending between opposing endpoints of the cylinder such that the cylinder and the strap define a loop such that the loop is positioned for selectively inserting the block for coupling the cylinder to the block.

16. The assembly of claim 14, further including a shell positioned around the cylinder, the shell comprising at least one of fabric and leather wherein the shell is configured for shielding the cylinder.

17. An inclined and vented mattress assembly comprising:

a block, the block comprising foamed elastomer such that the block is resiliently compressible, the block being wedge shaped such that a first end of the block is dimensionally thicker than a second end of the block, the block having a base sized complementarily to a bed frame wherein the block is configured for positioning upon the bed frame, the first end, the second end, and opposing sides of the block being perpendicular to the base, the block measuring between 20.0 and 46.0 centimeters thick adjacent to the first end and between 7.0 and 38.0 centimeters thick adjacent to the second end, the block comprising:

a lower section, the lower section comprising at least one of latex foam and high density foam, a recess extending into an upper face of the block, the recess extending from proximate to the first end to proximate to the second end of the block, the recess extending between the opposing sides of the block, the recess extending from 7.0 to 15.0 centimeters into the upper face, the recess extending approximately 10.2 centimeters into the upper face, and an upper section positioned in the recess and coupled to the lower section such that the upper section occupies the recess, the upper section comprising viscoelastic polyurethane foam;

a set of channels positioned in the block, the set of channels extending between at least two openings positioned in the block such that the set of channels is configured for venting the block, the set of channels being positioned in the lower section proximate to the upper section, the set of channels comprising a set of pipes, the pipes being resiliently flexible, the set of channels comprising a pair of first segments and a set of three second segments, the first segments being figure eight shaped, each second segment being coupled to and extending between the first segments;

a blower coupled to the block proximate to a respective one of the openings such that the blower is in fluidic communication with the set of channels wherein the blower is configured for motivating air through the set of channels for cooling the block;

a power module coupled to the block, the power module being operationally coupled to the blower such that the power module is positioned for selectively powering the blower, the power module comprising a power cord wherein a plug of the power cord is configured for plugging into an electrical outlet for coupling the blower to a source of electrical current;

a heating module coupled to the block, the heating module being operationally coupled to the power module wherein the heating module is configured for selectively heating the air passing through the set of channels for warming the block, the heating module comprising a heating element, the heating element being integral to at least one of the blower and the set of pipes;

a controller coupled to the block proximate to the blower, the controller being operationally coupled to the power module, the blower, and the heating module such that the controller is positioned for selectively coupling the blower and the heating module to the power module, the controller being dial type wherein the controller is configured for selectively turning for actuating the blower and for selecting a heating level for the heating module;

a set of springs coupled to and positioned in the lower section of the block, each spring extending from proximate to the base to proximate to the upper section of the block wherein the set of springs is configured for supporting a user positioned upon the upper section of the block;

a cylinder selectively couplable to the block such that the cylinder is positioned on the upper face proximate to the second end of the block and such that the cylinder extends substantially between the opposing sides of the block, the cylinder comprising at least one of latex foam and high density foam such that the cylinder is resiliently compressible wherein the cylinder is configured for selectively positioning feet of the user;

a fastener coupled to the cylinder, the fastener being configured for selectively coupling to the block for coupling the cylinder to the block, the fastener comprising a strap coupled to and extending between opposing endpoints of the cylinder such that the cylinder and the strap define a loop such that the loop is positioned for selectively inserting the block for coupling the cylinder to the block; and a shell positioned around the cylinder, the shell comprising at least one of fabric and leather wherein the shell is configured for shielding the cylinder.

* * * * *